United States Patent [19]

Bachand

[11] 4,190,526

[45] Feb. 26, 1980

[54] PORTABLE SCREENING PLANT

[75] Inventor: Ernest C. Bachand, Auburn, Mass.

[73] Assignee: Pioneer Cover-All, Inc., North Oxford, Mass.

[21] Appl. No.: 867,272

[22] Filed: Jan. 5, 1978

[51] Int. Cl.[2] ..... B07B 1/42

[52] U.S. Cl. ..... 209/245; 209/421

[58] Field of Search ..... 209/13, 241, 245, 247, 209/261, 259, 420, 421, 260, 387; 198/311, 313

[56] References Cited

U.S. PATENT DOCUMENTS

| | | | |
|---|---|---|---|
| 504,342 | 9/1893 | Gibson | 209/245 |
| 613,770 | 11/1898 | Loder | 209/245 X |
| 1,846,668 | 2/1932 | Barber | 209/241 |
| 2,396,954 | 3/1946 | Kranz | 209/260 |
| 2,397,959 | 4/1946 | Gephart | 209/241 X |
| 2,553,897 | 5/1951 | Crist | 209/260 X |
| 2,864,561 | 12/1958 | Mosk | 209/420 X |
| 2,922,510 | 6/1960 | Zetterlund | 209/241 X |
| 3,162,600 | 12/1964 | Montgomery | 209/259 |
| 3,402,816 | 9/1968 | Taylor | 209/260 |
| 3,439,806 | 4/1969 | Kass | 209/260 |
| 3,461,968 | 8/1969 | Longley | 209/421 X |
| 3,477,573 | 11/1969 | Andersson | 209/260 |
| 3,526,318 | 9/1970 | Erickson | 209/13 |
| 3,599,784 | 8/1971 | Rossi | 198/313 |
| 3,701,422 | 10/1972 | Downey | 209/241 |
| 3,909,401 | 9/1975 | Thompson | 209/421 |
| 4,055,251 | 10/1977 | Pieton | 209/38 X |
| 4,058,198 | 11/1977 | O'Neill | 198/313 |

FOREIGN PATENT DOCUMENTS

| | | | |
|---|---|---|---|
| 2134545 | 1/1973 | Fed. Rep. of Germany | 209/245 |
| 1291555 | 10/1972 | United Kingdom | 209/421 |
| 1449001 | 9/1976 | United Kingdom | 209/247 |

*Primary Examiner*—Robert Halper

*Attorney, Agent, or Firm*—Weingarten, Maxham & Schurgin

[57] ABSTRACT

A portable screening plant which can be readily transported and easily installed at an operating site for screening of gravel or other particulate materials. The plant comprises an endless loop conveyor belt mounted on a frame which also supports a hopper for supply of material to the belt. The shaker is adjustably attached to the frame by a linkage mechanism to permit raising of the shaker to an operating position and lower thereof to a closed travelling position. The hopper includes reciprocatory wiper blades to prevent accumulation of material on the hopper walls.

5 Claims, 2 Drawing Figures

PORTABLE SCREENING PLANT

FIELD OF THE INVENTION

This invention relates to aggregate screening apparatus and more particularly to portable screening apparatus which can be readily transported and deployed at a remote site for providing gravel or other screened particulate material.

BACKGROUND OF THE INVENTION

Portable screening apparatus is known by which particulate materials such as rocks and gravel can be screened and sifted for use. Examples of known screening apparatus are shown in U.S. Pat. Nos. 2,922,510 and 3,402,816. In general, such apparatus includes a hopper and an associated grizzly disposed at the lower end of an inclined endless conveyor belt, at the upper end of which is disposed a sifting mechanism which discharges screened material into a truck bin or other receptacle for later use. A load of gravel or other particulate material is dumped upon the grizzly where most of the material will pass through the bars into the hopper for dispensing onto the conveyor belt. Larger objects remaining on the grizzly can be manually or automatically removed. The conveyor belt supplies material to the sifter which provides a sifted load to the truck. Such apparatus is often mounted on wheels, as shown in the above-cited patents, so that the entire rig can be trailed by a truck to an operating site. In the apparatus of U.S. pat. No. 2,922,510, a screening member is foldable during transportation of the apparatus and is adjustably positioned by means of link chains.

SUMMARY OF THE INVENTION

In brief, the present invention provides a portable screening plant which is of simple and reliable construction to be readily transported and easily installed at an operating site for screening operation. The plant comprises an endless loop conveyor belt mounted on a frame which includes wheels supporting the frame by means of telescoping members to provide a means for raising the conveyor to intended operating heights, and a shaker at the upper end of the conveyor which can be raised to an operating position and lowered to a closed travelling position by a rigid linkage mechanism. A hopper is disposed at the lower end of the conveyor belt for supply of material to the belt and includes a grizzly at the upper end thereof and wiper blades moveable within the hopper to prevent accumulation of dirt and other material on the hopper walls.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
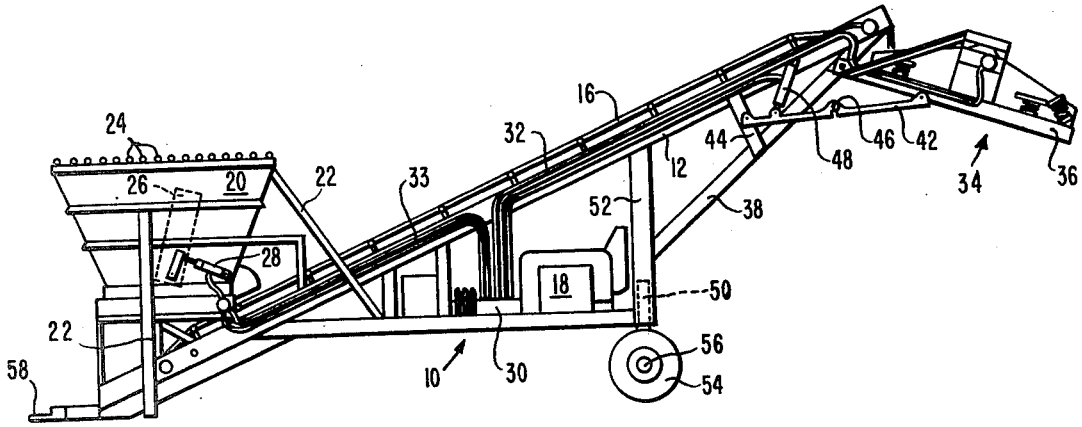
FIG. 1 is an elevation view of a portable screening plant according to the invention.

Referring to the drawings there is shown a portable screening plant which includes a frame 10 having an inclined frame structure 12 supporting a plurality of rollers 14 around which is disposed a conveyor belt 16 in an endless loop. The conveyor belt is moveable by any well-known transmission means coupled to a motive source such as an engine 18 mounted on frame 10. A hopper 20 is disposed at the lower end of the conveyor belt 16 and has a discharge end disposed in association with the belt to provide a supply of gravel or other particulate material to the belt. The hopper is supported in a generally vertical position by suitable struts 22 and includes a grizzly 24 over the upper supply end of the hopper. A pair of wiper blades 26 are disposed within the hopper, each blade being in wiping contact with a respective side wall of the hopper and being rotatable in a reciprocatory manner to scrape loam, dirt, or other material from the hopper sides to prevent sticking and accumulation of material within the hopper. The blades 26 are each reciprocated by means of a hydraulic actuator 28 operated by hydraulic controller 30 coupled thereto by fluid lines 32.

A shaker 34 is disposed at the upper end of the conveyor in a position to receive material discharged from the upper end of the conveyor belt. Shaker 34 includes a frame 36 pivotally attached at one end to the inclined struts 38 of frame 10, such as by a pivot rod 40. A pair of articulated links 42 are each pivotally connected at one end to frame 36 and at the other end to respective struts 44, the links 42 each being hinged at a central point by pivot rod 46. A hydraulic actuator 48 on each side of the frame interconnects a respective link 42 and frame structure 12. The shaker 34 is itself of known construction and operation to accomplish by vibratory action screening of the material supplied thereto by the conveyor belt.

The frame 10 includes a pair of telescoping members 50 disposed within respective vertical members 52 of the frame, the telescoping members being attached at their lower ends to a wheel assembly which includes wheels 54 and axle 56. The end of frame 10 adjacent to hopper 20 includes a coupling element 58 by which the entire apparatus can be attached to a truck or other vehicle for trailing to and from an operating site. The frame can be elevated by means of telescoping members 50 by any appropriate hydraulic or other means to raise the shaker 34 to an intended height so that, for example, a truck can back under the shaker for receiving a supply of screened and sifted gravel or other material.

Figure 2:
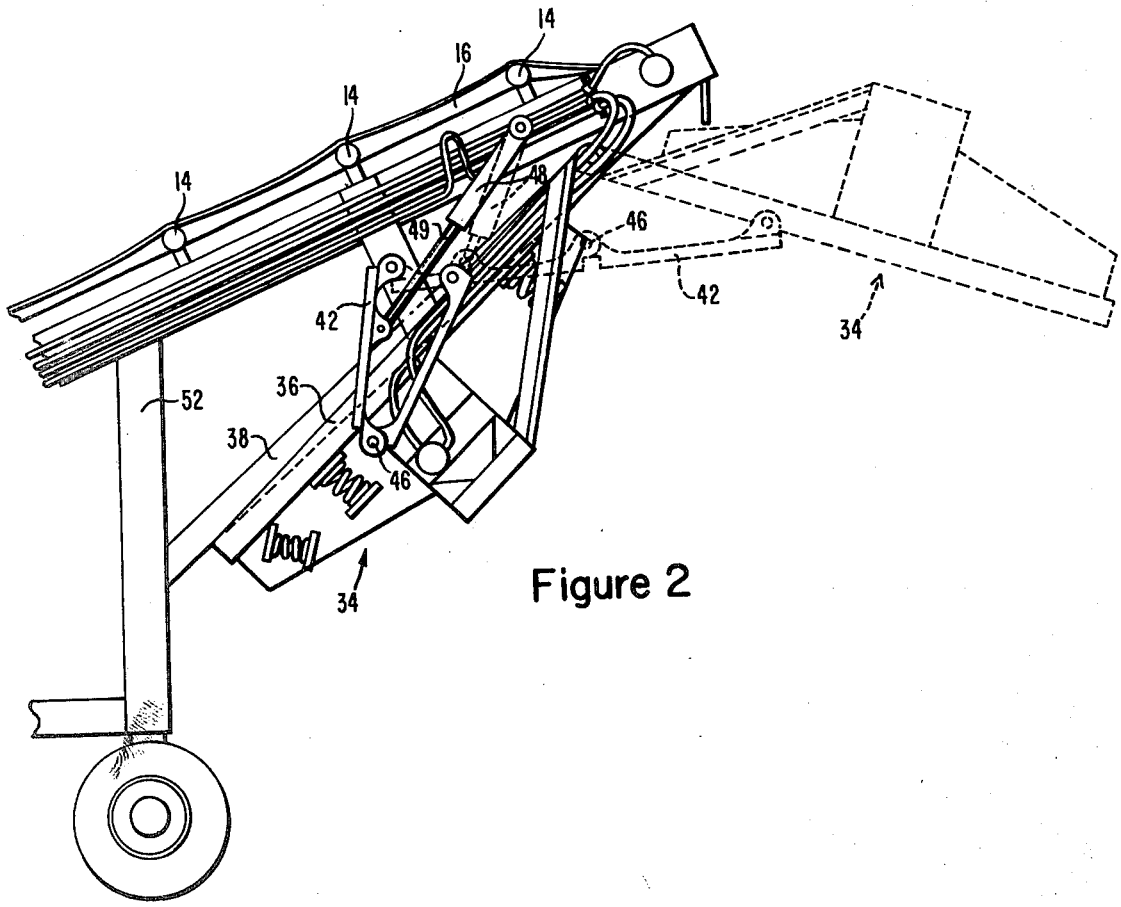
FIG. 2 is a cutaway elevation view of the portable screening plant of FIG. 1 illustrating the folding shaker.

The shaker 34 is moveable between a raised operating position, shown in FIG. 1, and a lowered stowage or transporting position, shown in FIG. 2. Raising and lowering of the shaker is accomplished by means of hydraulic actuators 48 which are driven by hydraulic controller 30 coupled by appropriate ones of fluid lines 32 to the actuators. With the pistons 49 of actuators 48 in their retracted position, the links 42 are disposed in open linear disposition to maintain the frame 36 of the shaker in its raised operating position for receipt of material from the conveyor belt. To lower the shaker to its transporting position, as in FIG. 2, the actuator pistons 49 are extended to cause folding of links 42 about pivot rod 46 and downward pivoting of frame 36 into its lowered position adjacent to struts 38 and below the conveyor belt. The raised position of shaker 34 is also illustrated in dotted outline in FIG. 2.

It will be appreciated that the portable screening plant is completely self-contained and can be readily moved to an operating site and quickly placed in use. The plant functions in a known manner to provide a supply of screened or sifted gravel or other particulate material to a truck or other container. The invention is not to be limited except as indicated in the appended claims.

What is claimed is:

1. A portable screening plant comprising:

a support frame including an inclined conveyor support disposed in an inclined path;

an elongated endless loop conveyor belt disposed along said inclined path and extending between a lower supply end and an upper discharge end;

means mounted on said support frame and coupled to said conveyor belt for causing movement of the belt along said path;

a hopper attached to said support frame and disposed in a generally vertical disposition with its discharge end in association with the lower end of the conveyor belt and including a grizzly disposed over the upper supply end;

a plurality of wiper blades disposed within the hopper and each rotatably mounted for wiping contact with a respective hopper side wall;

hydraulic means coupled to the wiper blades and operative to cause rotatable reciprocating movement of the blades;

a wheel assembly attached to and supporting said support frame and operative to permit trailing of the plant;

said wheel assembly being attached to the support frame by telescoping members by which the support frame and conveyor belt can be raised to intended operating heights;

a shaker adjustably attached to the upper end of the support frame and capable of being disposed in a raised position to receive material discharged from the conveyor belt, and in a lowered position for stowage below the conveyor belt;

said shaker including:

a shaker screen;

a rigid frame pivotally connected at one end to said support frame near the upper end of said inclined conveyor support;

a linkage mechanism securing the shaker to the support frame and including a pair of articulated two section links each pivotally connected at one end to said support frame at a position below the pivotal connection of the shaker frame, and at the other end to the shaker frame at a position outward of the pivotal connection thereof to the support frame, each of said links being centrally hinged;

a pair of hydraulic actuators each interconnecting a respective one of said links and said support frame each pivotally connected at one end to said support frame and at the other end to an associated link;

said hydraulic actuators being operative in a retracted position to retain said links in an open linear disposition to maintain the shaker in its raised operating position, and being operative in an extended position to cause folding of said links and downward pivoting of the shaker into its lowered position.

2. The portable screening plant of claim 1 wherein said hydraulic means coupled to the wiper blades includes for each of said blades a hydraulic actuator supported by said hopper and operative to cause rotatable reciprocating movement of the blade.

3. The portable screening plant of claim 2 including a hydraulic controller mounted on said support frame and coupled to said hydraulic actuators for controlling the operation thereof.

4. For using in a portable screening plant having an elongated endless loop conveyor belt supported by a frame; a hopper disposed in association with one end of the conveyor belt for supplying material thereto; a shaker associated with the other end of the conveyor belt for receiving material discharged therefrom, said shaker including a shaker screen and a rigid frame pivotably connected at one end to said support frame near the upper end of said conveyor belt; a linkage mechanism adjustably connecting the shaker to the support frame and comprising:

a pair of articulated two section links each pivotally connected at one end to said support frame and at the other end to said shaker frame, each of the links being centrally hinged;

a pair of actuators each interconnecting a respective one of said links and said support frame and each pivotally connected at one end to the support frame and at the other end to an associated link;

said actuators being operative in a retracted position to retain said links in an open linear disposition to maintain the shaker in its raised operating position, and being operative in an extended position to cause folding of said links and downward pivoting of the shaker into its lowered position.

5. The invention of claim 4 wherein said actuators includes a plurality of hydraulic actuators each interconnecting a respective one of the links and the support frame.

* * * * *